United States Patent [19]

Kosakai

[11] 4,014,274

[45] Mar. 29, 1977

[54] METHOD AND MACHINE FOR SEWING TOGETHER MATTRESS COVERS

[75] Inventor: Tamajiro Kosakai, Tokyo, Japan

[73] Assignee: France Bed., Ltd., Tokyo, Japan

[22] Filed: Dec. 23, 1975

[21] Appl. No.: 643,825

[30] Foreign Application Priority Data

Dec. 27, 1974 Japan ..... 50-519

[52] U.S. Cl. ..... 112/3 R

[51] Int. Cl.[2] ..... D05B 11/00

[58] Field of Search ..... 112/2, 3 R, 3 A, 117–119, 112/121.11, 121.12, 121.14, 121.15, 121.26, 121.23

[56] References Cited

UNITED STATES PATENTS

| | | | |
|---|---|---|---|
| 2,646,013 | 7/1953 | Haas | 112/3 R X |
| 3,641,954 | 2/1972 | Redman et al. | 112/3 R |
| 3,664,280 | 5/1972 | Redman et al. | 112/3 R |

*Primary Examiner*—G. V. Larkin

*Attorney, Agent, or Firm*—Flynn & Frishauf

[57] ABSTRACT

A mattress covering sewing machine includes a pair of upper and lower support plates for supportingly sandwiching therebetween a cushion wrapped with a pair of box-like outer covers. The support plates have outer peripheral portions extending in a manner to correspond to the shape of the outer peripheral portion of the cushion and coming into contact with the outer peripheral portion of the cushion through the box-like outer cover. The upper plate is mounted to be vertically movable so that the cushion is automatically and uniformly compressed in a direction of thickness of a cushion to permit the outer marginal edge portions of the adjacent box-like covers to be projected outward. The outer marginal edge portions of the adjacent box-like covers are sewn together to provide a mattress. The sewing device can be moved around the entire outer marginal edge portions of the adjacent box-like outer covers.

15 Claims, 12 Drawing Figures

M
M
IIIa
IIIa

METHOD AND MACHINE FOR SEWING TOGETHER MATTRESS COVERS

BACKGROUND OF THE INVENTION

This invention relates to a method and machine for sewing together the outer marginal edge portions of adjacent mattress outer covers with which a cushion is wrapped.

As well known in the art, a mattress consists of a cushion constituting an inner structure and an outer covering which wraps the cushion. Conventionally, the outer covering consists of a few outer covers i.e., a pair of upper and lower outer covers and a gusset covering the side of the cushion, all of which three-dimensionally wrap the cushion in all sides. Where the cushion is wrapped with the outer covers, one outer cover and gusset are sewn together at their adjacent outer marginal edge portions into an open box-like configuration. A mattress is formed by wrapping a cushion with the box-like outer cover while disposing another outer cover under the open end of the box-like outer cover and sewing together the outer marginal edge portions of the adjacent outer covers. The outer covering is tightly wrapped over the cushion in all sides without any sagging and it must be made somewhat smaller in size than the outer dimension of the cushion. When the sewing is finally effected, the outer marginal edge portions of the adjacent outer covers are sewn together while fairly strongly compressing the cushion with the elbow of the sewer. In the prior art, therefore, a high skill is required in sewing together the outer marginal edge portions of the adjacent outer covers and, in addition, it is difficult to uniformly compress the cushion and it is impossible, therefore, to manufacture mattress on a quantity production basis.

SUMMARY OF THE INVENTION

It is accordingly the object of this invention to provide a method and machine for sewing together mattress covers which are capable of automatically forming uniform mattresses, on a quantity production basis, for a short period of time without any skill.

In a method according to this invention, a pair of mattress covers are cut with a cutout at each of four corners. The adjacent sides of the cutout of the mattress covering are sewn together into a box-like configuration. The cushion is wrapped with the box-like outer covers from upper and lower sides of the cushion. The wrapped cushion is sandwiched between a pair of support plates and automatically and uniformly compressed in a direction of the thickness of the cushion. The outer marginal edge portions of the adjacent box-like outer covers are sewn together in such a state that the cushion is uniformly compressed.

A mattress covering sewing machine, therefore, includes a pair of upper and lower support plates adapted to sandwich therebetween a cushion wrapped with a pair of outer covers, the outer peripheral portions of said paired support plates extending toward each other in a manner to correspond to the outer peripheral portions of the wrapped cushion; compression means for uniformly compressing the cushion, in a direction of thickness of the cushion, through the support plate to permit the outer marginal edge portions of the adjacent outer covers to be projected outward; and a sewing device for sewing together the projected marginal edge portions of the adjacent outer covers to form a mattress. The sewing machine further includes means for supportingly carrying the sewing device around the entire marginal edge portions of the adjacent outer covers.

Even when the mattress is of a double-, semi-double- or single-width, the support plate can preferably be varied in its width, while adequately supporting the outer peripheral portions of the wrapped cushion.

When the mattress has a different width, it is preferred that the lower support plate be vertically movable so as to maintain a predetermined sewing level.

DETAILED DESCRIPTION OF THE PREFERRED EMBODIMENTS

Figure 1:
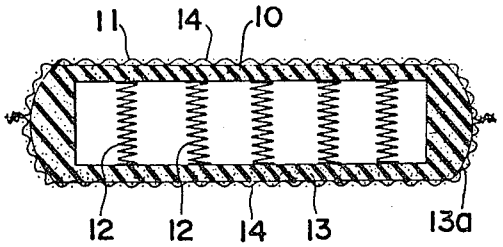
FIG. 1 is a cross-sectional view schematically showing a mattress as formed according to this invention.
Figure 2:
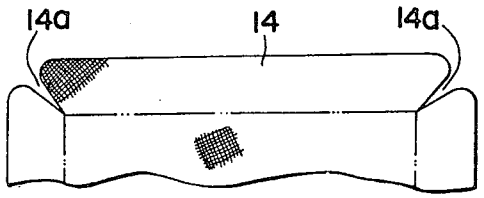
FIG. 2 is a partial development view showing an outer cover to be used in FIG. 1.

A mattress manufactured according to this invention consists basically of a cushion 10 and an outer covering 11 which wraps the cushion in all sides. The cushion 10 has a flattened urethane outer layer 13 into which a number of compression springs 12 are parallelly disposed. The outer peripheral surface 13*a* of the outer layer 13 is curved outward. The outer covering 11 is wrapped over the cushion by sewing together the outer marginal edge portions of a pair of outer covers 14. Each outer cover 14 has a rectangular shape with a notch 14*a* at each corner as shown in FIG. 2 and the notch 14*a* is outwardly curved at its open end. The adjacent side portions of the notch 14*a* are sewn together into an open box-like configuration. The cushion 10 is wrapped with the two box-like outer covers and, after the wrapped cushion is compressed, the outer marginal edge portions of the two adjacent box-like outer covers are sewn together to provide a mattress as shown in FIG. 1.

A mattress covering sewing machine will now be described below.

Figure 3:
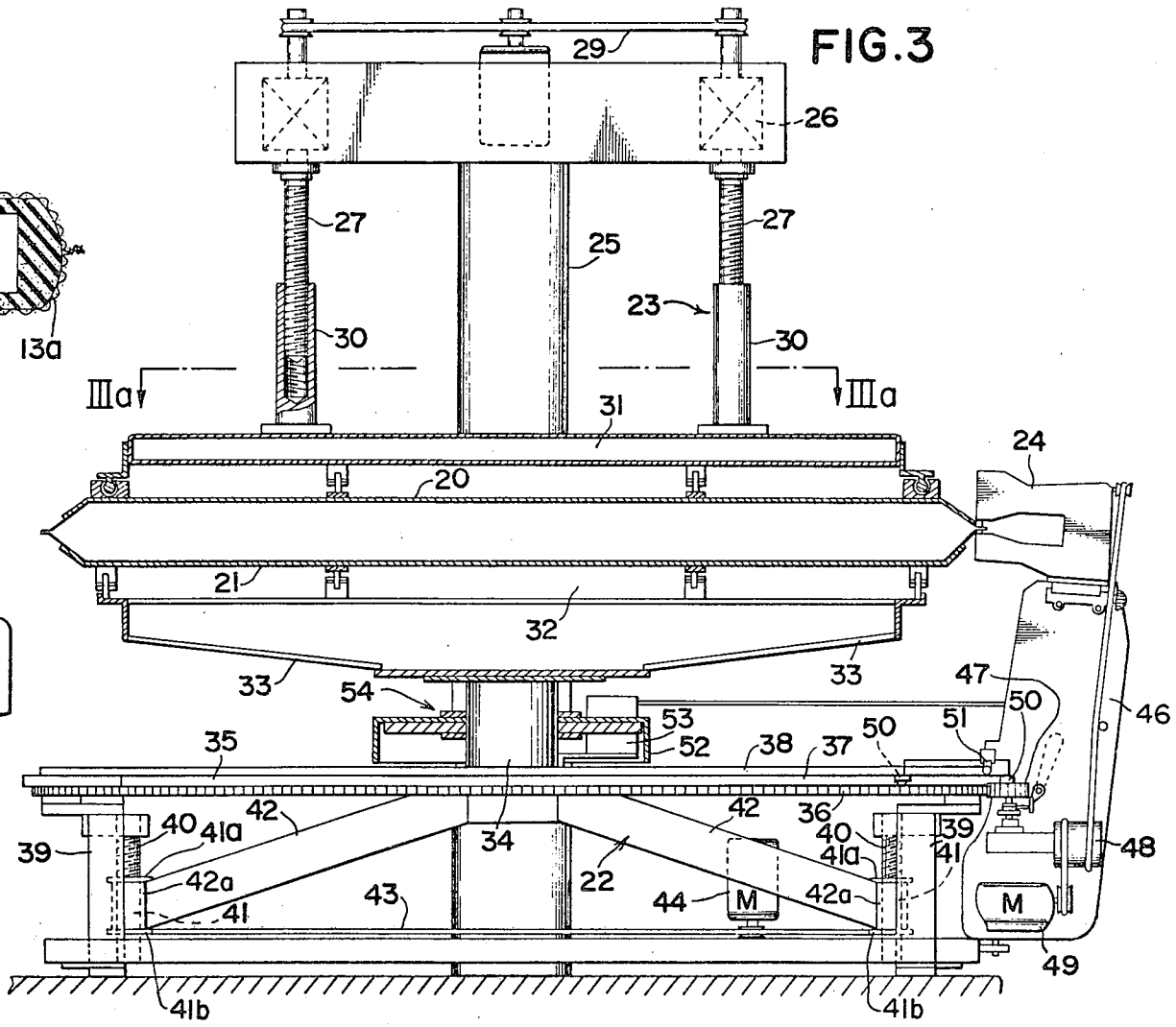
FIG. 3 is a front view, partially in cross-section, showing a mattress covering sewing machine according to one embodiment of this invention.
Figure 3A:
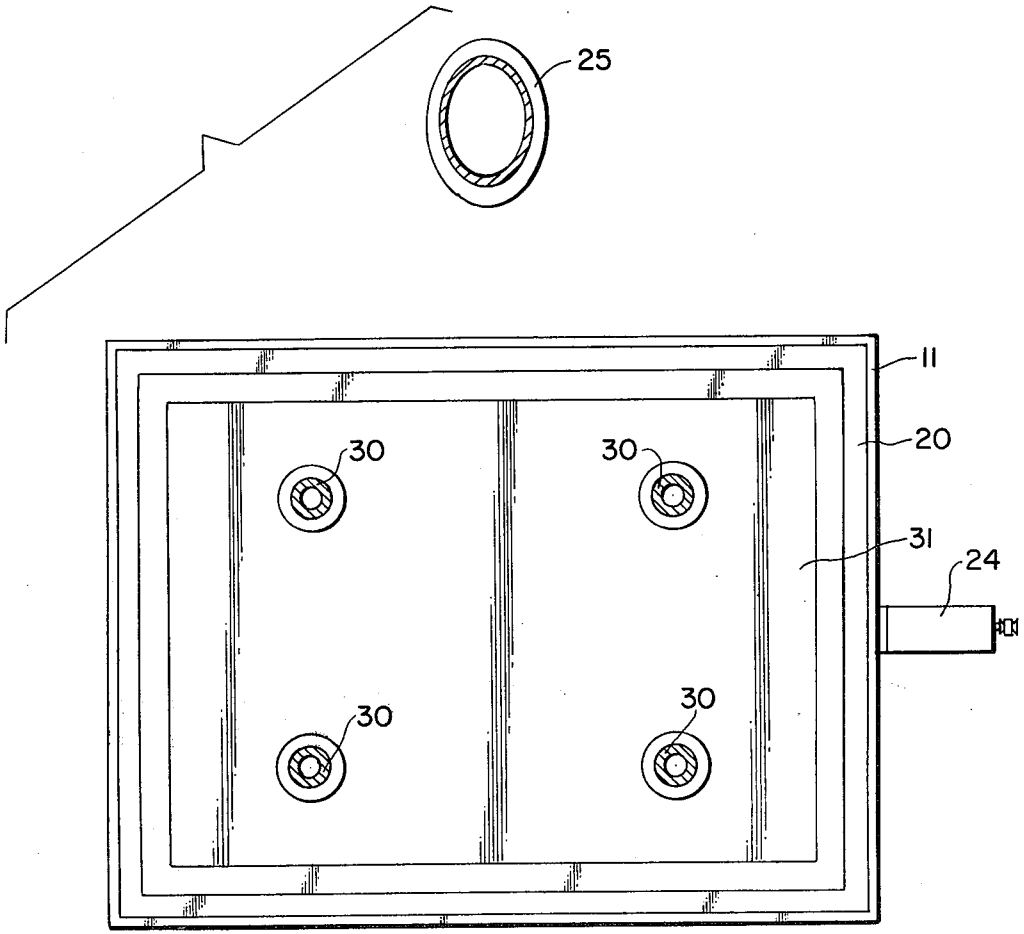
FIG. 3*a* is a partial sectional view along the line III*a*—III*a* in FIG. 3.
Figure 4:
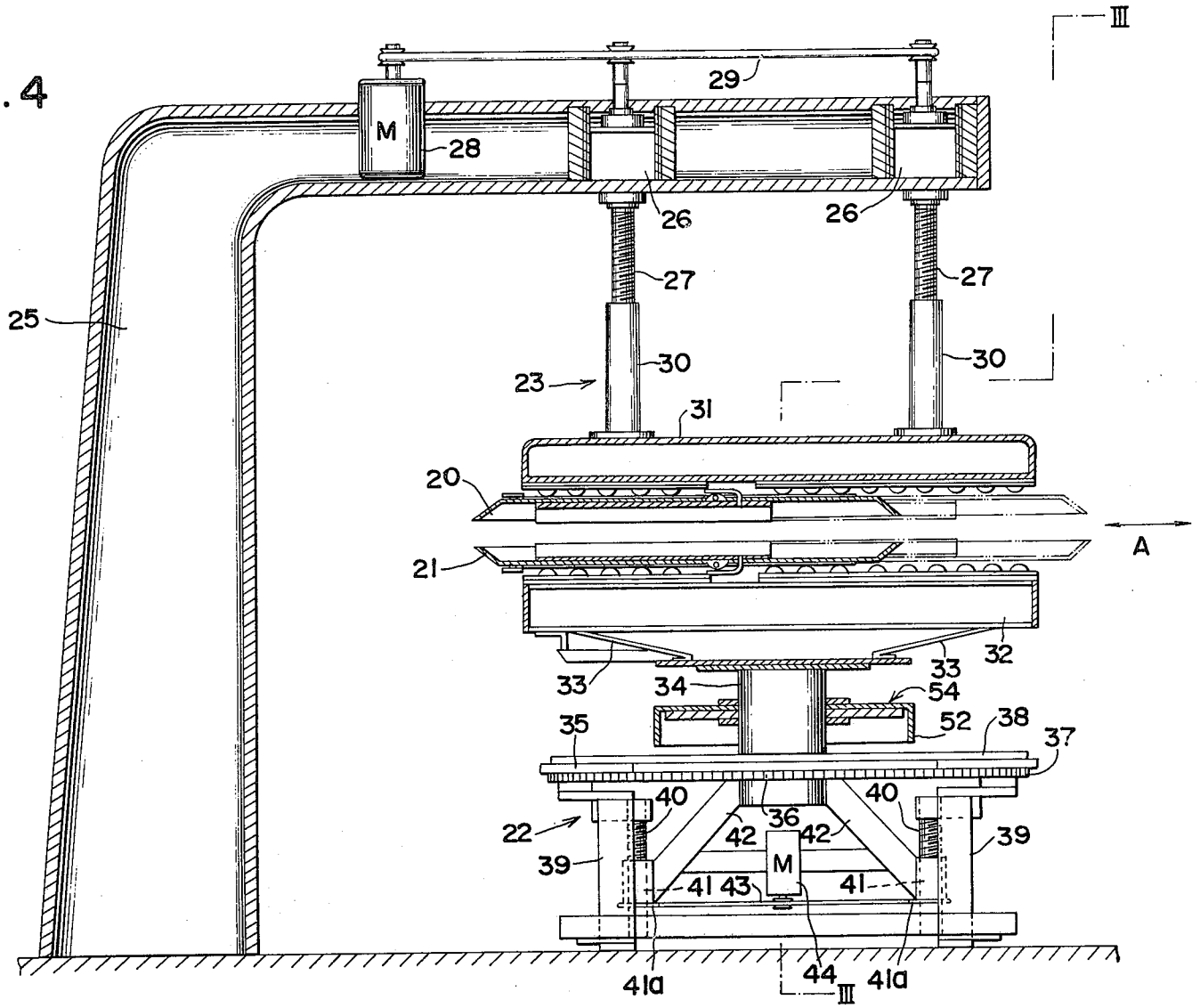
FIG. 4 is a left side view, partially in cross section, showing the mattress covering sewing machine in FIG. 3.

In FIGS. 3, 3*a* and 4 the sewing machine comprises a pair of upper and lower support plates 20, 21 between which the cushion wrapped with two box-like outer covers is disposed; a support mechanism 22 adapted to vertically movably support the lower support plate 21; compression means 23 for verticaly compressing the wrapped cushion disposed between the upper and lower support plates by lowering the upper support plate 20; and a sewing device 24 for sewing together the outer marginal edge portions of the two adjacent box-like outer covers.

The compression means 23 has an inverted L-shaped stand 25 whose forward end extends in a cantilever fashion. Four drive shafts 27 are each rotatably journaled, through a radial bearing 26, at the overhanging forward end portion. The axial movement of each rotatable shaft 27 is restricted by its respective bearing 26. The drive shafts 27 are disposed in a spaced-apart relation and are simultaneously driven through a belt 29 by a motor 28 mounted on the overhanging forward end portion of the stand 25. Each drive shaft 27 has a male screw at the lower end portion which is threadably engaged with a female screw formed in respective connectors 30. The lower end of each connector 30 is secured to the top surface of an upper base 31. The upper support plate 20 is mounted integral with the upper base 31 and is vertically movable as a unit. When the motor 28 is driven, each shaft 27 is rotated to cause the upper support plate 20 to be vertically moved through the connector 30 and upper base 31. In this case, the same results are obtained by providing a female screw at the lower portion of each drive shaft 27 and a male screw at the connector 30. The upper support plate 20 is supported, by a mechanism as will be later described, in a direction of the width of the mattress i.e. in a direction indicated by arrow A in FIG. 4. A lower support plate 21 is supported by a holding means 22 so as to be vertically moved. The holding means 22 is disposed below the lower support plate 21 and supports the lower base 32 so that the lower support plate 21 is moved in a direction indicated by the arrow A in FIG. 4. Below the base 32 is disposed a reinforcing assembly having reinforcing plates 33 which extend diagonally so as to reinforce the base 32. The top surface of a movable column 34 is secured to the central undersurface of the reinforcing assembly. The lower portion of the movable column 34 pierces through the central portion of the table 35 and extends downward. The table 35 has a size substantially the same as the size of the bases 31 and 32. The table 35 has a rack 36 around the entire outer periphery thereof and first and second rails 37 and 38 along the entire outer periphery thereof. The table 35 is supported by four legs 39. In the neighborhood of each leg 39, guide poles 40 with male screw threads each are mounted upright alongside respective legs 39. Respective nut members 41 are threadably inserted over each guide pole 40 and connecting rods 42 are each connected between each nut member 41 and the movable column 34. One end of the connecting rod 42 is fixed to the movable column 34 and each connecting rod 42 is equipped with a sleeve 42*a*. The sleeve of each connecting rod 42 is loosely fitted over the respective nut member 41. A pair of upper and lower flanges 41*a*, 41*b* is provided one at the upper end and one at the lower end of each nut member 41. The lower flange 41*b* of each nut member 41 acts as a pulley and a belt 43 is entrained around the pulleys. A motor 44 is mounted on a connecting rod 42 and a wheel on the drive shaft of the motor 44 is engaged with the belt 43. When the motor 44 is rotated, the four nut members 41 are turned through the belt 43 to cause each nut member 41 to be vertically moved around the respective guide rod 40. By so doing, each sleeve 42*a* of each respective connecting rod 42 is moved together with its respective nut member 41 to cause the movable column 34 to be vertically moved through the connecting rods 42. As a result, the lower support plate 21 is vertically moved through the reinforcing member 33 and lower base 32. Even though the cushion is varied in its thickness, a sewing level can be maintained at a predetermined level by vertically moving the lower support plate.

In the neighborhood of the table 35 a sewing device 24 for sewing together the outer marginal edge portions of the adjacent box-like outer covers is supported so that it is moved around the entire outer periphery of the table 35. As shown in FIG. 3 the sewing device 24 is movably supported by a carrier member 46. On the carrier member 46 is rotatably mounted a pinion 47 in mesh with the rack 36. The pinion 47 is rotated through a clutch mechanism 48 by a motor 49 secured to the carrier member 46. On the carrier member 46 are rotatably mounted a pair of horizontal rollers 50 which sandwich the first rail 37 therebetween and an upstanding (or vertical) roller 51 which moves along the second rail 38. When the pinion 47 is rotated by the motor 49, the carrier member 46 can be moved around the entire periphery of the table by engaging the pinion with the rack 36. The movement of the carrier member 46 is smoothly and securely effected by a combination of the first rail 37 and horizontal rollers 50 and a combination of the second rail 38 and upright rollers 51. The sewing device 24 is supported on the carrier member 46 so that the inclination angle can be adjusted. The sewing operation can be effected by the motor 49 through the clutch mechanism 48.

On the movable column 34 is provided a collecting mechanism including a rotatably supported electrode 52 and a fixed electrode 53 secured to the movable column 34 and always electrically connected even during the rotation of the rotatable electrode 52. The collecting mechanism 54 is formed, for example, by forming a projecting annular electrode on the undersurface of an insulating rotating plate and providing in the upper surface of a fixed plate an annular-grooved electrode which is engaged with the projecting annular electrode. If in this case an electric wire from the motor 49 is electrically connected to the rotatable electrode 52 and the fixed electrode 53 is connected to a power source (not shown), it is possible to prevent the electric wire from being entangled around the table 35 due to the rotatable electrode 52 being rotated together with the movement of the carrier member 46 around the table 35.

Figure 5:
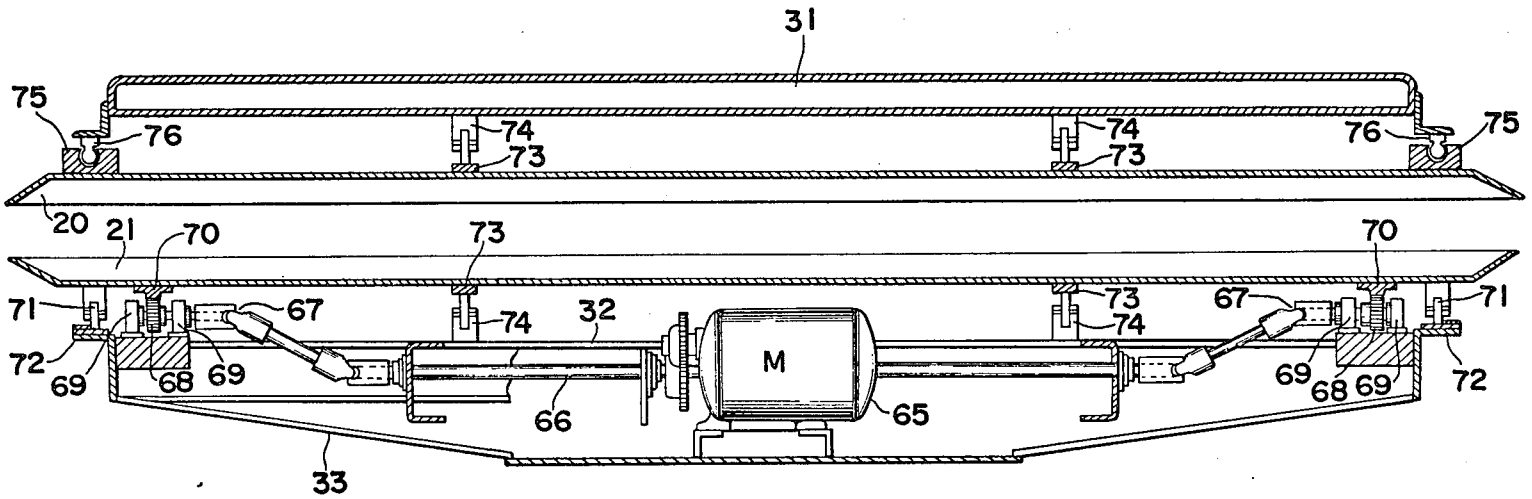
FIG. 5 is an enlarged view showing a mechanism for moving a support plate in a direction of width of a mattress as shown in FIG. 3.

The structure and movement mechanism of the support plates 20 and 21 will now be described by referring to FIGS. 5 to 7.

Since the upper and lower support plates 20 and 21 are nearly similar in structure to each other, only the lower support plate will be described below. As shown in FIG. 6 the lower support plate 21 has a plate member 56 and an inclining edge portion 55 upwardly outwardly flared along the outer marginal edge of the plate member 56 all of which form a rectangular dish-like configuration. As will be apparent from FIGS. 6 and 7, the support plate 21 comprises three members 57, 58 and 59. The first member 57 and third member 59 are formed in the same plane and are provided with respective inclined peripheral portions 55 at respective ends which are remote from the abutting ends of the first and third members 57 and 59. The second member 58, on the other hand, has an inclining peripheral portion only at each side thereof and is made smaller in size than the first and third members 57 and 59 so that the second member 58 is snugly received in the adjacent abutted first and third members 57 and 59. One end portion of the second member 58 is secured to the open end portion of the third member 59. When the lower end plate 21 is in a first position, as shown in FIG. 6, corresponding to a "single width" of the mattress, an end 57*a* of the first member 57 abuts against an end 59*a* of the third member 59 and, in this case, the second member 58 is disposed in the first member 57. When the third member 59 is moved in a direction of an arrow B in FIG. 6 into a second position, as shown in FIG. 7, corresponding to "a double width" of the mattress, the second member 58 is slidably moved on the first member 57 and only one end portion of the second member 58 is engaged with the first member 57. The support plate 21 is positioned so that a third position corresponding to a "semi-double width" of the mattress is taken by moving the second member 58. A latch mechanism 60 is fixed on the lower surface of the first member 57 so that the movement of the second and third members 58 and 59 relative to the first member is restricted. The latch mechanism 60 has an engaging lever 61 spring-urged in a direction indicated by an arrow C. The restrictive movement of the second and third members 58 and 59 relative to the first member 57 can be attained by fitting the end of the lever into one of three aligning holes in the support plate 21 which correspond to the first, second and third positions of the support plate. As shown in FIG. 5 a motor 65 and rotatable shaft 66 are mounted on the base 32 and the rotatable shaft 66 extends in a longitudinal direction of the support plate 21. The shaft 66 is operatively connected through a pair of gears to the rotating shaft of the motor 65. The shaft 66 is connected at each end to a pinion 68 through a universal joint 67 and the pinion 68 is rotatably supported on the bearing 69. A rack 70 is mounted on the undersurface of the support plate 21 so as to be engaged with the pinion 68, and extends in a direction of the width of the mattress. As a result, the shaft 66 is rotated, through the paired gears, by the motor 65, causing the pinion 68 to be rotated through the universal joint 67. The support plate 21 can be moved in a direction of the width of the mattress by engagement of the pinion 68 with the rack 70.

Between the support plate 21 and the base 32 is disposed a guide means for smoothly moving the support plate 21. The guide means includes a combination of guide rolls 71 and guide rail 72 and a combination of paired guide rail 73 and paired guide rolls 74. The guide rolls 71 are rotatably arranged in a line along the side edge of the support plate 21. The guide rail 72 is mounted on the base 32 and under the rolls 71 and has an outwardly raised outer end. The guide rail 73 is mounted on the undersurface of the support plate 21 and in a position relatively remote from the side of the support plate and the guide rolls 74 are mounted on the base 32 in an opposite relation to the guide rail 73.

The same guide means is also provided between the upper support plate 20 and the base 31. The guide rolls 74 are provided in a line at each side of the upper base 31. On the upper support plate 20 is mounted a pair of rails 73 on which the guide rolls 74 are guided. A combination of inner and outer rails 76 and 75 can be used. In this case, the outer rail 75 is provided at each side of the upper support plate 20 and extends in a direction of width of the upper support plate and the inner rail 76 is provided at each side of the upper base 31 and having a large diameter end portion engaged with the inner rail 76. The inner rail 76 is movable in a horizontal direction, i.e. in a direction of the width of the mattress, with respect to the outer rail 75, but the inner rail 76, together with the outer rail 75, is moved, as a unit, in the vertical direction.

Figure 8:
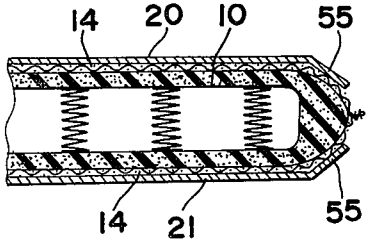
FIG. 8 is a cross-sectional view, as partly broken away, showing the state in which a cushion wrapped with a pair of outer covers is sandwiched between a pair of support plates.

The mattress having an outwardly curved outer edge portion 13*a* at each side is compressed between the upper and lower support plates 20 and 31 as shown in FIG. 8.

Figure 9:
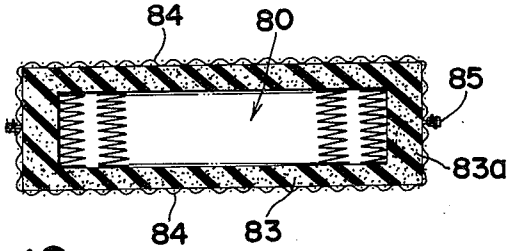
FIG. 9 is a cross-sectional view schematically showing another mattress as formed according to this invention.
Figure 10:
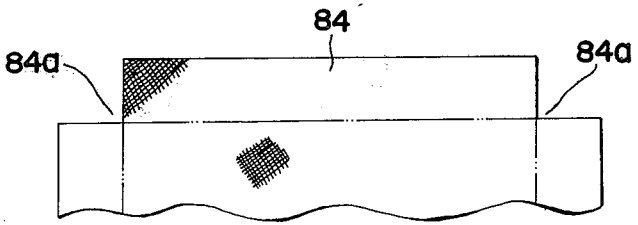
FIG. 10 is a development view showing another outer cover as used in the mattress in FIG. 9.

FIG. 9 shows, unlike the mattress in FIG. 8, a mattress having a uniform thickness over the length of the cushion. In the mattress having the outwardly curved outer edge portion 13*a* at each side, the outer cover 14 should be accurately cut according to the thickness of the cushion 10 and the curve of the outer edge portion 13*a* so that it has a slit 14*a* at each of four corners. In the mattress having a uniform thickness over the length of the cushion, however, the outer cover 14 can be easily cut according to the thickness of the cushion so that it has a rectangular cutout 84*a* at each of four corners as shown in FIG. 10. Reference numeral 85 shows a tape. Sewing can be effected after attaching such a tape to the outer marginal edge portions of the adjacent outer cover 84.

The operation of the mattress covering sewing machine will now be described below.

The upper and lower support plates 20 and 21 are positioned according to the width of the mattress to be formed. The upper and lower support plates 20 and 21 are located, by the operation of the motor 65, into a first position i.e. in a "single-width38 position (FIG. 6) in the case of a single size mattress; a second position i.e. in a "double-width" position (FIG. 7) in the case of a "double size" mattress; or a third position intermediate between the first and second positions i.e. in a "semi-double-width" position in the case of a semi-double size mattress. A cushion 10 wrapped with the paired outer covers 14 is placed on the so located lower support plate 21. By driving the motor 28 the upper support plate 20 is lowered toward the lower support plate 21 to sandwich the wrapped cushion therebetween so that the outer marginal edge portions of the outer covers 14 come into contact with each other. The wrapped cushion 10 is compressed to the extent that the outer marginal edge portions of the outer covers 14 are projected outward as shown in FIG. 8. The position and angle of the sewing device 24 are adjusted into a position in which a needle of the sewing device 24 can sew together the outer marginal edge portions of the adjacent outer covers 14. The outer marginal edge portions of the adjacent outer covers are sewn together, while the sewing device 24 is moved around the periphery of the table 35 through the carrier member 46 by moving the motor 49. As a result, a mattress is formed. When a cushion 10 differs in its thickness, sewing can be effected at a predetermined level without changing the level of the sewing device 24 by driving the motor 44 so as to vertically move the lower support plate 21.

Explanation will now be made of the case when a mattress having a different width is formed.

Figure 6:
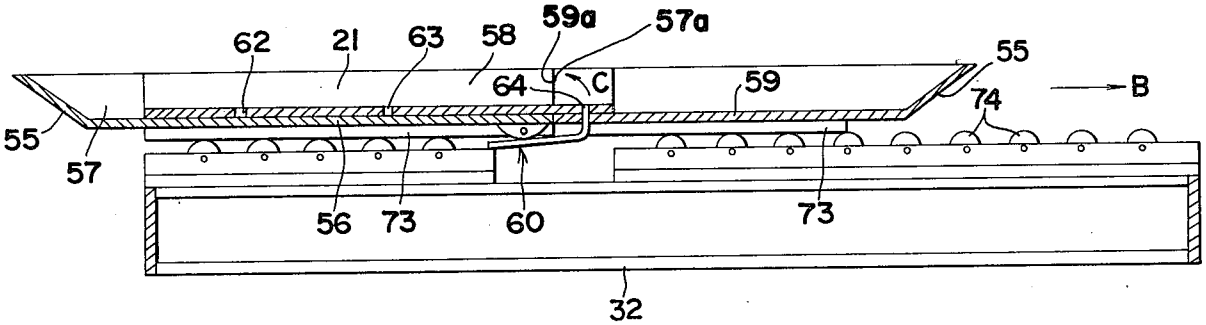
FIG. 6 is a cross-sectional view showing one position taken by the support plate in FIG. 3.
Figure 7:
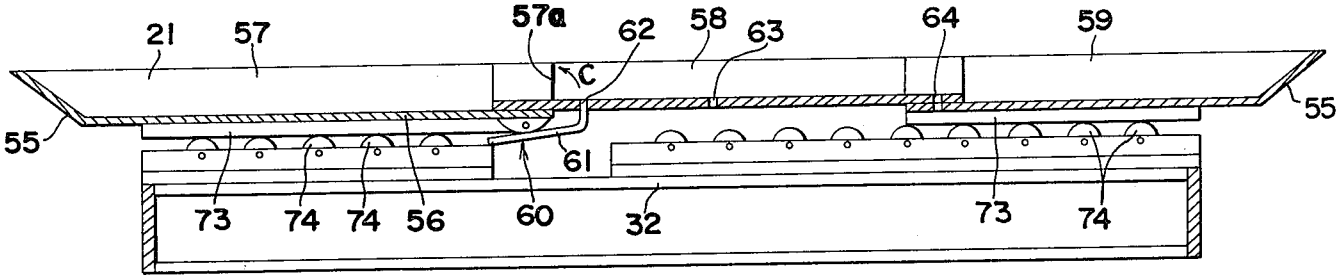
FIG. 7 is a cross-sectional view showing another position taken by the support plate in FIG. 3.

When a double-size mattress is formed, the upper and lower support plates 20 and 21 are located in the "double-width" position by moving the third member 59 in a direction of B in FIG. 6 and fitting the end of the engaging lever 61 into the hole 62 in the second member 58. Since the double-width position corresponds in dimension to the table 35, the sewing device 24 is moved around the table 35 by simply driving the motor 49 so that the outer marginal edge portions of the adjacent outer covers 14 can be sewn together.

Figure 11:
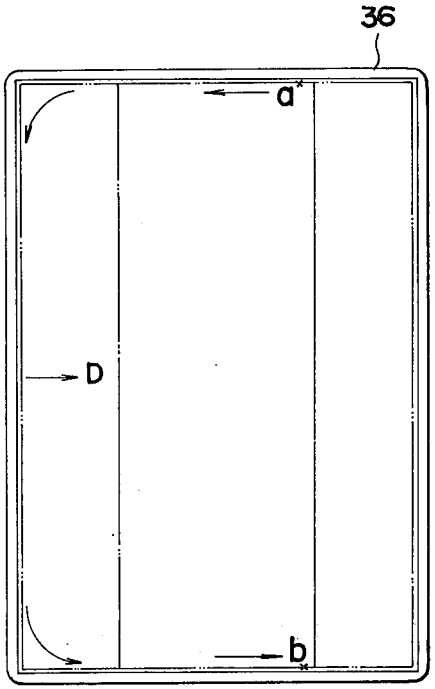
FIG. 11 is an explanatory view showing an operational direction of a sewing device in FIG. 3.

In the case of a single-size mattress, the upper and lower support plates 20 and 21 are located into the "single-width" position by moving the third member 59 in a direction opposite to the direction B. In this position, the support plate is so designed as to have a dimension corresponding to the dimension of the single-size mattress and the support plates 20 and 21 are located on the left side as indicated by a solid line in FIG. 11. The sewing operation is effected in this case, starting in the neighborhood of a location a at the rear side of the wrapped cushion and ending in the neighborhood of a location *b* at the front side of the wrapped cushion while tracing along arrows in FIG. 11. However, no further sewing can be effected, because the rack 36 is preliminarily designed to correspond to the dimension of the double-size mattress. The driving of the sewing device 24 is once stopped in this position and the support plate as a whole is moved, in a direction indicated by arrow D, through driving of the motor 65 into a position indicated by a dot-dash line. As a result, the remaining outer edge portions of the outer covers are placed along the rack and can be sewn together by moving the sewing device 24 around the table 35. Thus, the outer marginal edge portions of the outer covers can be sewn together as a whole. When the semi-double size mattress is formed, the support plates 20 and 21 are moved, in a direction opposite to the direction B, into the "semi-double width" position and the outer marginal edge portions of the outer covers are sewn together in the same manner as explained in the case of a single size mattress.

According to this invention uniform mattresses can be manufactured on a quantity production basis without requiring any skill by wrapping a cushion with a pair of outer covers, uniformly compressing the wrapped cushion to permit the outer marginal edge portions of the outer covers to be projected outward, and sewing together the outer marginal edge portions of the outer covers around the entire periphery of the cushion.

What is claimed is:

1. A mattress covering sewing machine comprising:

a pair of upper and lower support means supportingly sandwiching therebetween a cushion wrapped with a pair of outer covers, said paired support means each having a variable width support plate, the outer peripheral portions of the support plates extending toward each other and being shaped to correspond to the outer peripheral portion of the wrapped cushion and coming into contact with the outer peripheral portion of the wrapped cushion, the widths of the variable width support plates being adjustable so as to correspond to the width of a mattress to be formed;

compression means for compressing the wrapped cushion, through at least one support plate, in the direction of the thickness of the cushion to cause the outer marginal edge portions of the outer covers to be projected outward;

sewing means for sewing together the outer marginal edge portions of the outer covers to form a mattress; and carrier means for supportingly carrying said sewing means around the entire outer marginal edge portions of the outer covers.

2. A mattress covering sewing machine according to claim 1, in which said support plates each include a pair of plate members oppositely disposed in the same plane and having ends which are adapted to selectively abut each other, the pair of plate members each having an outer peripheral support portion except at the abutting ends of said pair of plate members; and an intermediate plate member having an outer peripheral support portion only at each side thereof, the intermediate plate member being slidably movable along one of said pair of plate members and being secured to the other member of said pair of plate members; and said support means each have a mechanism for moving a plate member in the direction of the width of the mattress.

3. A mattress covering sewing machine according to claim 2, in which one plate member of each of said support plates is movable and said support means each having a locking mechanism in the neighborhood of the movable plate member and on the side opposite to the side on which the movable intermediate plate member is moved, said locking mechanism including a plurality of holes in the intermediate plate member and an engaging lever adapted to be urged toward the intermediate plate member and engageable into a corresponding one of the holes in the intermediate plate member according to the width of the mattress.

4. A mattress covering sewing machine according to claim 2, in which said support means each have a base supportingly movable in the direction of the width of the mattress and there is further provided a support plate moving mechanism including a rack mounted on the surface side of the support plate which confronts the base and extending in the direction of the width of the mattress, a pinion mounted on the base so as to be engaged with said rack, and a motor mounted on the base and operatively connected to said pinion.

5. A mattress covering sewing machine according to claim 2, in which said carrier means includes a table serrated at its outer periphery and carrying said lower support means, and a carrier member movable around the table and having a pinion gear in mesh with the serrated outer periphery of the table.

6. A mattress covering sewing machine according to claim 5, in which said carrier means includes a motor mounted on the carrier member and a clutch mechanism connected by a belt to the motor so as to transmit a drive force to said sewing means and said pinion gears.

7. A mattress covering sewing machine according to claim 2, in which said compression means includes means for lowering said upper support means to substantially uniformly compress the cushion, and there is further included means for raising and lowering said lower support means according to the thickness of the cushion.

8. A mattress covering sewing machine according to claim 7, in which said carrier means includes a table serrated at its outer periphery and carrying said lower support means, and a carrier mechanism movable around the table and having a pinion gear in mesh with the serrated outer periphery of the table.

9. A mattress covering sewing machine according to claim 7, in which one plate member of each of said support plates is movable and said support means each have a locking mechanism in the neighborhood of the movable plate member and on the side opposite to the side on which the movable intermediate plate member is moved, said locking mechanism including a plurality of holes in the intermediate plate member and an engaging lever adapted to be urged toward the intermediate plate member and engageable into a corresponding one of the holes in the intermediate plate member according to the width of the mattress.

10. A mattress covering sewing machine according to claim 7, in which said support means each have a base supportingly movable in the direction of the width of the mattress and there is further provided a support plate moving mechanism including a rack mounted on the surface side of the support plate which confronts the base and extending in the direction of the width of the mattress, a pinion mounted on the base so as to be engaged with said rack, and a motor mounted on the base and operatively connected to said pinion.

11. A mattress covering sewing machine according to claim 7, in which said compression means includes a connector having one end connected to said upper support means and the other end threaded along the axis thereof, and a drive shaft having a threaded portion engaged with the threaded end of said connector and rotatably supported while being restricted in its axial movement, said upper support means being lowered through said connector by rotationally driving said drive shaft.

12. A mattress covering sewing machine comprising:

a pair of upper and lower support means supportingly sandwiching therebetween a cushion wrapped with a pair of outer covers, said paired support means each having a support plate, the outer peripheral portions of the support plates extending toward each other and being shaped to correspond to the outer peripheral portion of the wrapped cushion and coming into contact with the outer peripheral portion of the wrapped cushion;

compression means for lowering said upper support means to substantially uniformly compress the wrapped cushion through at least one support plate in the direction of the thickness of the cushion to permit the outer marginal edge portions of the outer covers to be projected outward;

means for raising and lowering said support means according to the thickness of the cushion;

sewing means for sewing together the outer marginal edge portions of the outer covers to form a mattress; and carrier means for supportingly carrying said sewing means around the entire outer marginal edge portions of the outer covers.

13. A mattress covering sewing machine according to claim 12, in which said compression means includes a connector having one end connected to said upper support means and the other end threaded along the axis thereof, and a drive shaft having a threaded portion engaged with the threaded end of said connector and rotatably supported while being restricted in its axial movement, said upper support means being lowered through said connector by rotationally driving said drive shaft.

14. A mattress covering sewing method comprising the steps of 1. cutting a pair of covers with a cutout at each of four corners according to the thickness and the shape of the outer periphery of a mattress to be formed;
2. sewing together the adjacent sides of the cutout of the paired covers into an open box-like configuration;
3. wrapping a cushion with the pair of the open box-like outer covers from the upper and lower sides of the cushion;
4. automatically and uniformly compressing the wrapped cushion in the direction of the thickness of the mattress so that the central areas of the outer marginal edge portions of the outer covers are projected outward; and
5. sewing together the projecting outer marginal edge portions of the outer covers.

15. A method according to claim 13, wherein the step of cutting a pair of covers comprises cutting a substantially rectangular cutout at each of the four corners.

* * * * *